US005918897A

United States Patent [19]

Hansen et al.

[11] Patent Number: 5,918,897

[45] Date of Patent: Jul. 6, 1999

[54] SNOWBOARD BINDING

[75] Inventors: Reinhard Hansen, Salzburg; Werner Jettmar, Weiden am See, both of Austria

[73] Assignee: Goodwell International Limited, Tortola, Virgin Islands (Br.)

[21] Appl. No.: 08/536,064

[22] Filed: Sep. 29, 1995

[30] Foreign Application Priority Data

Sep. 30, 1994 [DE] Germany ..... 44 35 113

[51] Int. Cl.[6] ..... A63C 9/00

[52] U.S. Cl. ..... 280/611; 280/14.2

[58] Field of Search ..... 280/607, 611, 280/14.2, 614, 615, 623, 624, 626, 634

[56] References Cited

U.S. PATENT DOCUMENTS

| | | | |
|---|---|---|---|
| 4,937,952 | 7/1990 | Olivieri | 36/119 |
| 5,172,924 | 12/1992 | Barci | 280/14.2 |
| 5,556,123 | 9/1996 | Fournier | 280/607 |
| 5,771,609 | 6/1998 | Messmer | 36/89 |

FOREIGN PATENT DOCUMENTS

| | | | |
|---|---|---|---|
| 0 646 334 A1 | 9/1994 | European Pat. Off. | A43B 5/04 |
| 2627097 | 8/1989 | France | A62C 13/00 |
| 8902125 U | 2/1989 | Germany | A63C 9/084 |
| 9113766 U | 11/1991 | Germany | A63C 9/00 |

*Primary Examiner*—Richard M. Camby

*Attorney, Agent, or Firm*—Senniger, Powers, Leavitt & Roedel

[57] ABSTRACT

A snowboard binding having a heel element that is pivotable in its open position sufficiently far that a snowboard boot can be inserted into the binding with the instep element held in place. The heel element is also pivotable into a closure position and held there by means of actuation devices. In this closure position, the heel element supports the heel of the snowboard boot in a predefined position and simultaneously presses the boot against the instep element.

17 Claims, 8 Drawing Sheets

SNOWBOARD BINDING

BACKGROUND OF THE INVENTION

The invention pertains to a snowboard binding of the type often referred to as "shell bindings" or "soft bindings," since they are designed to be used with relatively soft boots and have a high degree of flexibility, as is desired by so-called free-style skiers. Snowboards bindings in this field are shown in DE-GM 8,902,125.8 or DE-GM 9,113,766.7. These known bindings have a base element that is to be attached to the upper side of the snowboard and is normally fastened there by screws. An instep element is attached to the side walls extended laterally upward and consists in known bindings of one or more adjustable instep belts that reach over the front foot and the instep and thus pull the boot against the base plate. Moreover, these known bindings have a support or heel element attaches to the base plate so as to pivot and supports the rear side of the boot and simultaneously makes it possible to set a defined angle of inclination, which determines the so-called "forward lean" of the lower leg. In these known bindings, this heel element, which projects roughly 20–30 cm from the snowboard surface in normal skiing position, can be folded forward in the direction of the instep element so as to interfere less when transporting the snowboard. In both previously known bindings shown in DE-GM 8,902,125.8 or DE-GM 9,113,766.7, the angle of inclination of the instep element can be adjusted for the skiing position.

A similar snowboard binding, but with a stationary heel element, is also known from FR 2,697,097 A1 (FIG. 9).

In all these known snowboard bindings, the opening and closing of the binding is done only at the instep element, which makes getting into the binding particularly complicated. For DE-GM 9,113,766.7, for instance, two instep straps must be opened and kept unbuckled by hand, so that the boot can be inserted from above into the binding. Since the heel element normally defines a certain forward lean, the boot must then be pushed backwards in the direction of the heel element when it touches the base element, and then finally the instep buckles must be closed. At the same time, the binding must be readjusted after each new insertion, as is required for the rear binding after every lift trip, since the instep belts must always be completely opened and have no predefined closure position. In this process, the skier must bend backwards and thread the belt strap with his gloves into the closure buckles, which is not always possible with an iced-up binding. Viewed as a whole, therefore, these known bindings are quite cumbersome and uncomfortable to handle.

SUMMARY OF THE INVENTION

An object of the invention is to improve the snowboard binding of the type mentioned initially such that getting into and out of it is considerably simplified and that a predefined closure position of all elements of the binding is reassumed with very little effort after every closure of the binding.

Briefly, therefore, the invention is directed to a snowboard binding for binding a snowboard boot to a snowboard's upper surface. The binding has a base element to be fastened to the snowboard's upper surface, an instep element fastened onto the base element which instep element grips partially over the snowboard boot, a heel element which supports the snowboard boot's rear side. The heel element is pivotable rearwardly on the base element into an entry position in which the heel element lies generally parallel to the snowboard surface. In this entry position the snowboard boot is insertable into the binding. The binding also has actuation devices that pivot and hold the heel element forwardly into a closure position forwardly, in which closure position the heel element supports the snowboard boot and presses it against the instep element.

BRIEF DESCRIPTION OF THE DRAWINGS

The invention is described more specifically below on the basis of an embodiment example in connection with the drawings. Of these.

Identical reference numerals in the individual figures designate identical or functionally corresponding parts.

DETAILED DESCRIPTION OF THE INVENTION

Figure 1:
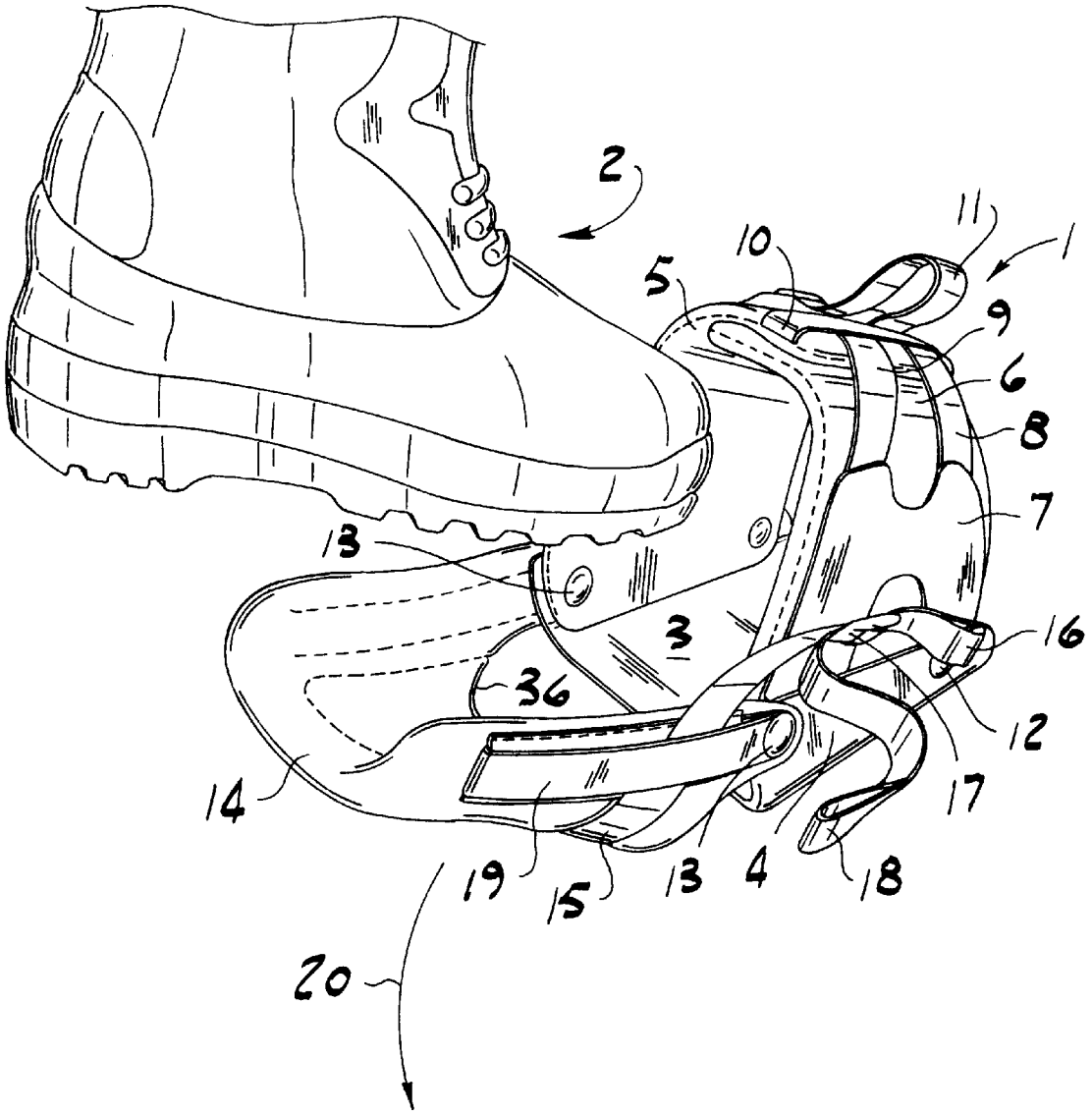
FIG. 1 is a perspective of the snowboard binding in the opening position.

In the snowboard binding of the invention, the heel element can be folded into an opening position rearwardly, so that the boot can be introduced into the binding with movement inclined forward/downward, which corresponds essentially to the natural pivoting motion of the knee joint. The instep element forms a stationary tunnel and need not be moved during the closure process. It is merely fit individually to the boot one time and then maintains this fit continuously. When the boot is inserted until it makes contact with the instep element, the heel element is folded upward by actuator devices forwardly, until it also has assumed a preset closure position. This predefined closure position also contains a preset forward lean. The boot is pushed further forward to a certain extent by this folding upward of the heel element, so that the desired clamping force is also produced. A clearly predefined position of the binding is thus obtained in every closure process. Moreover, stepping in is comfortable, due to the natural pivoting motion of the foot. The actuator devices for the pivoting of the heel element are preferably formed by belts or straps, so that a tug on a strap in the direction pointing away from the snowboard surface brings about the entire closure process. A complicated threading of straps or toothed belts into locking buckles is unnecessary.

Even the opening of the binding is very simple. The actuator device can be loosened by a simple operation, by which the heel element is folded into the opening position and the shoe is pulled out of the binding.

It is particularly advantageous for the actuation device to consist of a first strap, which is fastened on both sides in the front area of the base element and surrounds the heel element on the outside, and of a second strap which is attached to the upper area of the heel element and is connected to the first strap in such a manner that pulling on the second strap tightens the first strap along the outside of the heel element in the direction of its upper end, which moves the heel element into the closure position. The closure position has been reached when the second strap has moved into a predefined terminal position. The forward lean of the heel element can be adjusted by changing the length of the first strap. The instep element remains unchanged during this entire process.

Turning now to the figures, the snowboard binding 1, for the attachment of a snowboard boot 2 to a snowboard, has a base element 3 which is attached to the surface of the snowboard, by screws, for instance. This base element is plate-shaped in FIG. 1 and, on both sides, has side walls 4 projecting up essentially vertically from the snowboard surface and each with an instep element 5,6 attached. The instep elements 5,6 preferably have the form of padded flaps which initially project essentially upward from the base element 3 and then, bent over towards one another, overlap in a central area. This central area is inclined with respect to the base element 3 at an angle such that it fits the instep area of the snowboard boot 2. The two instep elements 5,6 thus form a type of tunnel, the height of which diminishes towards the front in the direction of the boot's toe. In order to hold the instep elements in position, draw plates 7 consisting of a somewhat stiffer material such as plastic are applied to the side walls 4, in order to the give the instep elements 5,6 a certain lateral support. Instep belts 8,9 are attached to the free upper ends of the draw plates and are threaded below a guide loop 10 and—as explained below in connection with FIG. 4—are connected to opposing belts of the other side. The instep belts 8,9 are connected here above a loop 11 and thus form a continuous belt.

The instep elements 5,6, as well as draw plates 7, are attached to the side walls 4 of the base element 3 by means of screws 12,13. The screws 13 present on both sides simultaneously serve as pivot bearings for a heel element 14 which constitutes the actual closure element of the binding and serves as a heel support. This heel element 14 is curved in a shell shape and fits to the back side of the boot. It is likewise padded. In the opening position illustrated in FIG. 1, the heel element is folded completely back to the rear and lies nearly parallel to the snowboard surface. Thus the tunnel formed by the instep elements 5,6 is freely accessible from the back side, so that the boot 2 can be introduced into the binding by a simple forward motion. The instep elements 5,6 then guide the boot's toe until the boot is held essentially in its final position by a stop on the latter.

To close the binding, the heel element 14 must be pivoted upward contrary to the direction of arrow 20. An actuation device is provided for this purpose and has a first strap 15 which is held in place by a loop 16 on both sides of the lateral walls 4 in their front area and wraps around the heel element 14 on the outside. In the opening position, this first strap 15 is loose and touches the outside of the heel element 14 in its lower area near the snowboard surface. The length of this first strap 15 can be adjusted, specifically by a strap buckle 17, through which the strap 15 is threaded and ends in a loop 18.

In order to keep the first strap 15 continuously engaged with the outside of the heel element 14, loops 19, through which the strap 15 is threaded, are provided on both outer sides of the heel element 14. These loops extend essentially over the entire length of the heel element 14 and can be provided with a hook and loop (such as VELCRO brand) closure.

An additional component of the actuation device is a second strap 21 (FIG. 2), connected to the first strap 15 and attached to the heel element 14 in its upper part by means of a clip 22. The connection between the first strap 15 and the second strap 21 is accomplished here by means of a loop, that is, the strap 21 is guided downward from the clip 22 along the back side of heel element 14, then wraps around the first strap 15 and is then guided back upwards, specifically, to a strap buckle 23, from which the second strap 21 then projects with its free end 24, which is shaped into a loop. If this free end 24 is pulled in the direction of the arrow 25, then the loop formed by the strap 21 and wrapping around the first strap 15 is shortened and the first strap 15 slides upwards along the outside of the heel element 14. This pivots the heel element 14 forward and the strap 15 is tightened. The complete closure position is achieved when the loop formed by the strap 21 and wrapping around first strap 15 has become so short that the first strap 15 comes to a stop on the clip 22. The binding has then been closed, with the forward lean, that is, the angle of inclination of the heel element 14 also being specified by the length of the strap 15. Since the second strap 21 has a defined and unambiguously reproducible final position due to the clip 22, the closure position of the heel element 14 is unambiguously and reproducibly specified. In the pivoting motion of the heel element 14, the boot is also pushed even further forward against the instep elements 5 and 6, so that there as well, there is an unambiguously defined and reproducible pressure force.

Figure 2:
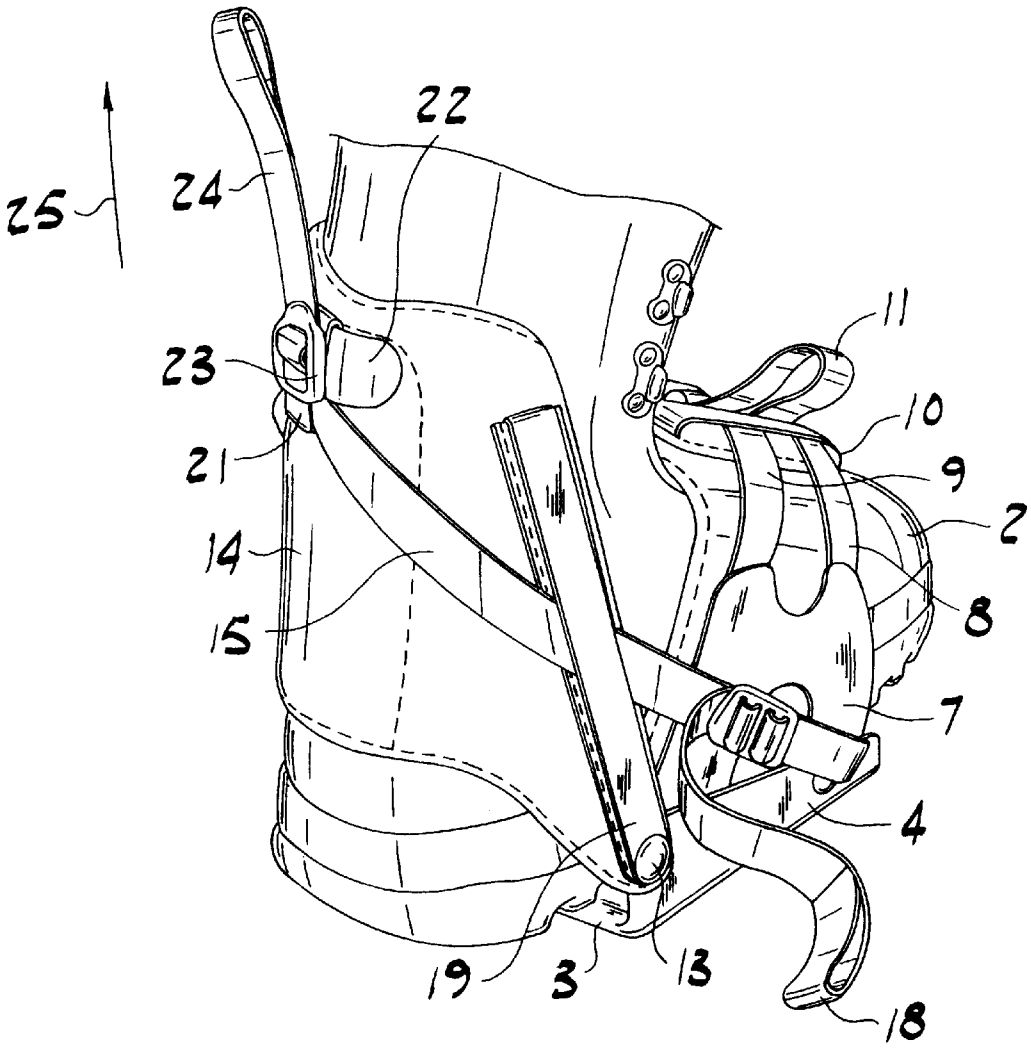
FIG. 2 is a perspective of the snowboard binding in the closure position.

FIG. 2 also shows how the first strap 15 is guided through the guide loop 19 and can move in its longitudinal direction if such is required. If this loop is provided with a hook and loop closure, then the strap 15 will glide only axially through the existing opening of the hook and loop closure, but is not displaced in the axial direction of the guide loop 19.

To open the binding, the buckle 23 is tilted so that the second strap 21 can lengthen and the first strap 15 permits a pivoting of the heel element 14 in the direction of arrow 20 in FIG. 1. The shoe can then be pulled back out of the binding without difficulty.

Figure 3:
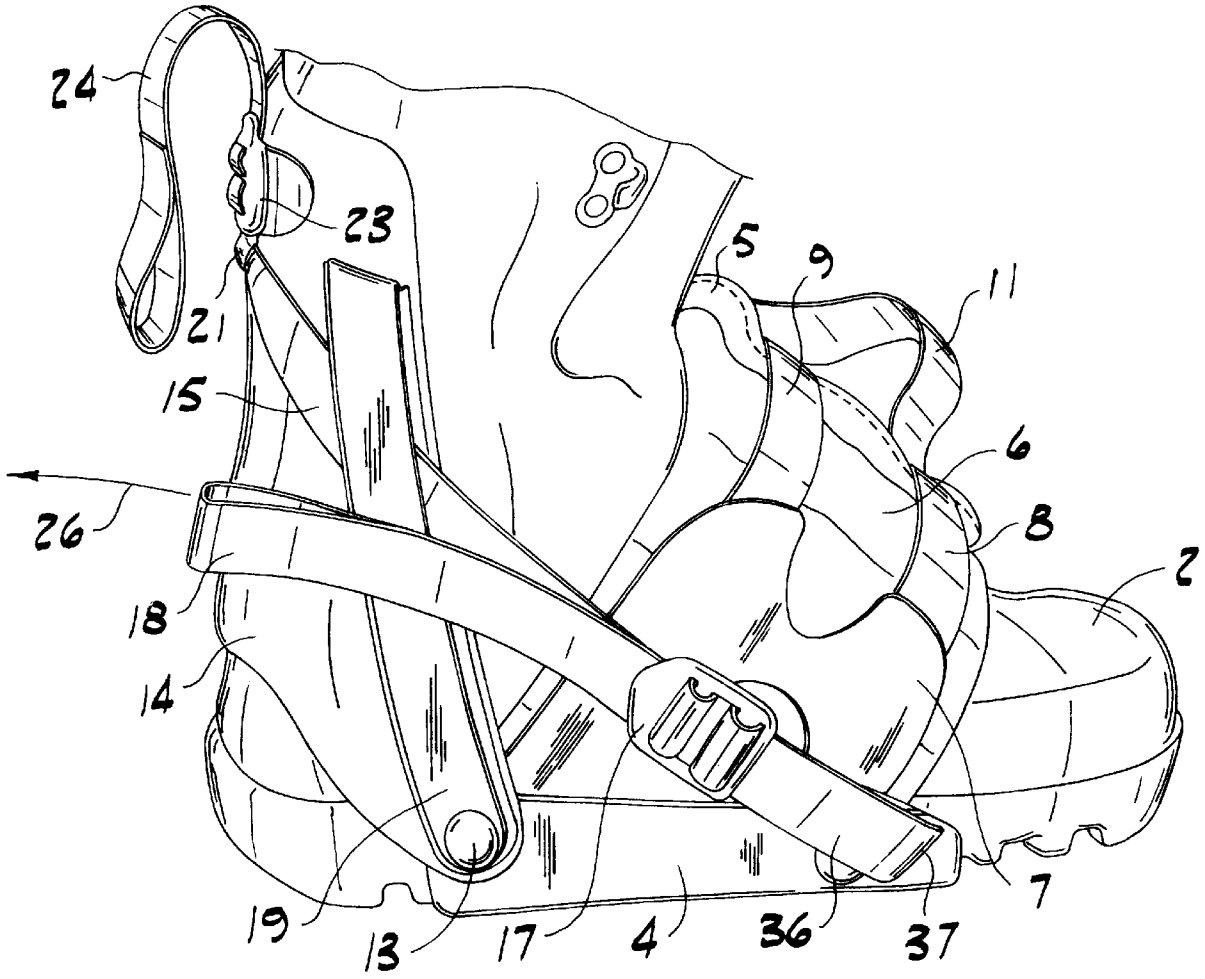
FIG. 3 is a perspective similar to FIG. 2 to illustrate the shifting of the forward lean of the heel element.

FIG. 3 clarifies the adjustment of the forward lean, that is the adjustment of the angle of inclination of the heel element 14 with respect to the snowboard surface. The strap 15 is threaded through a strap buckle 17, which is in turn threaded via a short strap loop 36 through an opening 37 of the lateral wall 4. The effective length of the strap 15 can be shortened by pulling on the loop 18 in the direction of the arrow 26 and lengthened by loosening the buckle 17. In this way, when the second strap 21 is in its predefined closure position, the forward lean of the heel element 14 can be adjusted, as well as the force with which the snowboard boot is pushed forward against the instep elements 5,6. This adjustment need in principle be done only one time, in order to fit the binding to the individual shoe, and need not be changed later, unless the skier would like to change the forward lean and/or the tangible "hardness" of the binding.

Figure 4:
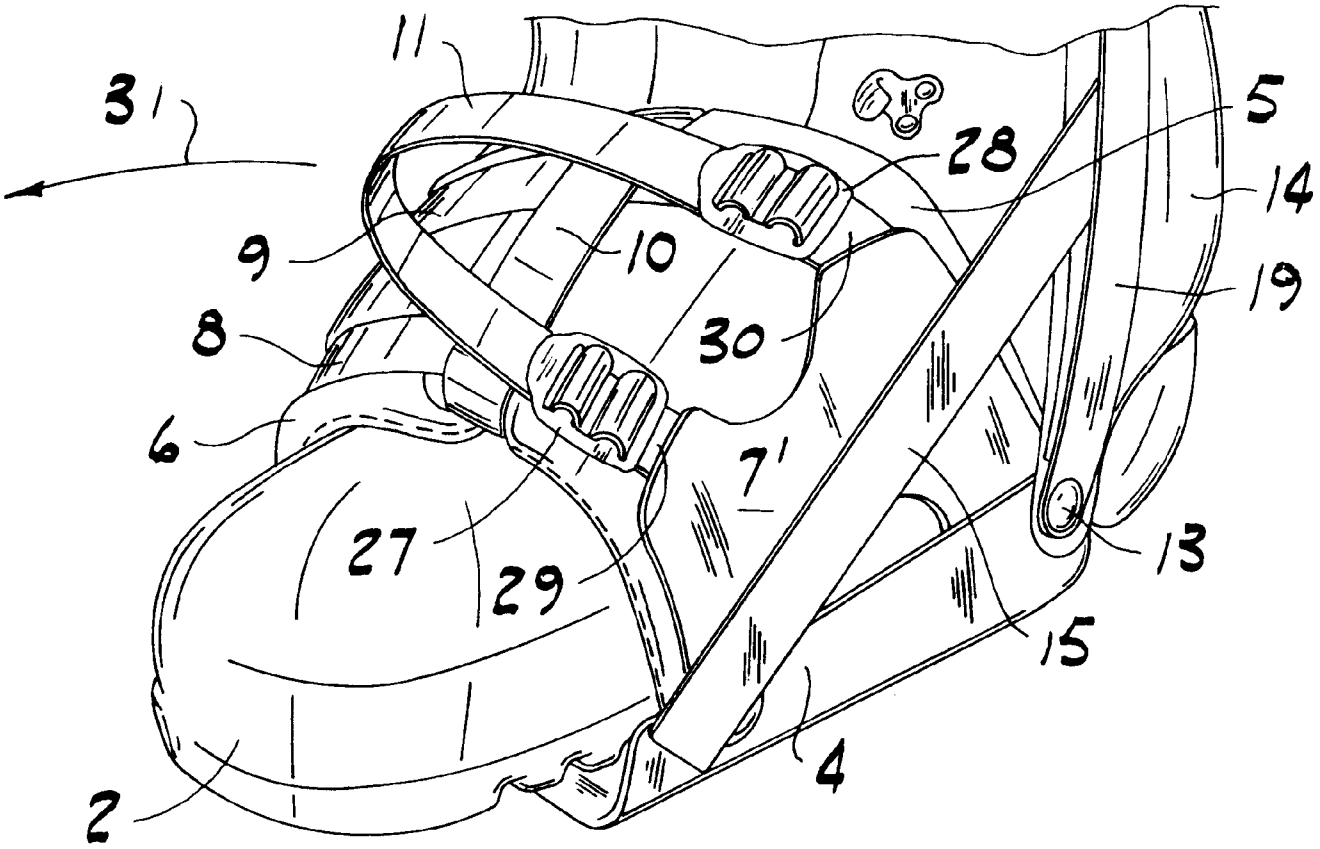
FIG. 4 is a perspective of the snowboard binding in the closure position to illustrate the adjusting of the instep element.

FIG. 4 clarifies the adjustment of the instep elements 5,6. Two strap buckles 27,28 are attached to one of the draw plates, labeled 7', by means of short strap loops 29,30. The strap sections 8,9 are each threaded through one of the strap buckles 27,28 and connected together by means of the loop 11. If loop 11 is pulled in the direction of arrow 31, then the effective length of the instep straps 8,9 shortens, whereby the instep elements 5,6 overlap further and thus make the binding tighter. Conversely, by gently tilting the strap buckles 27,28, the length of the instep straps 8,9 can be increased. Both adjustments are thus possible continuously rather than step-by-step.

Figure 5:
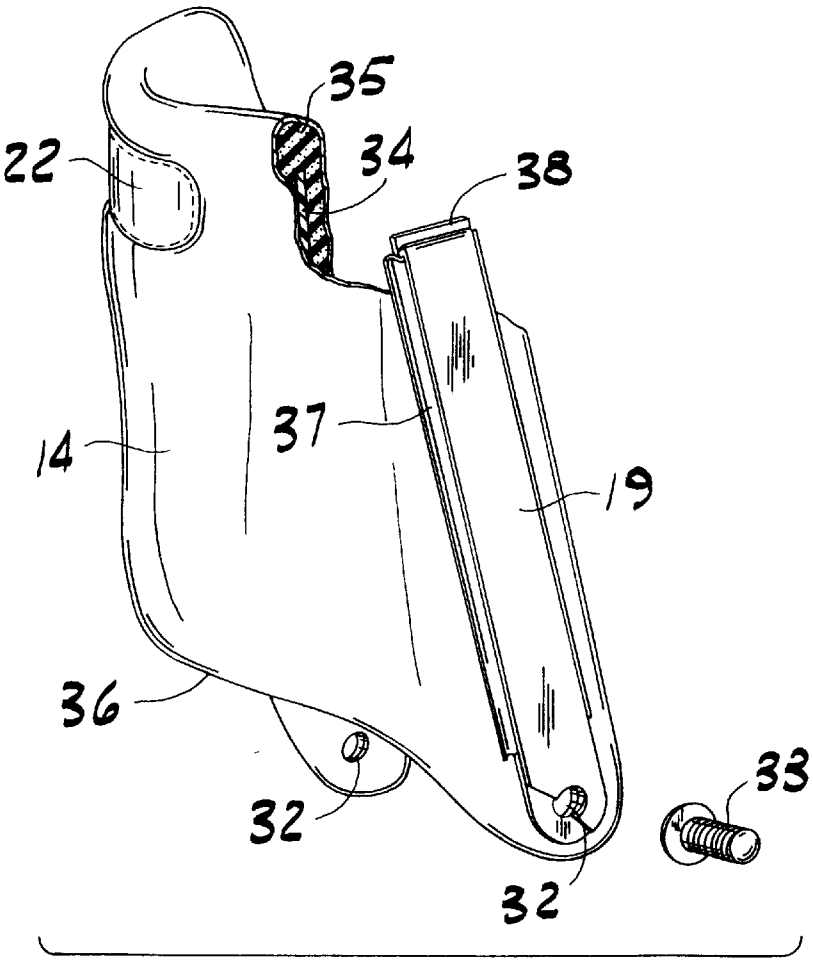
FIG. 5 is a perspective of the heel element.

FIG. 5 shows the heel element 14 in greater detail. It consists of a convex-curved, elongated body with a relatively stiff insert 34 and a padding 35 covering the latter. In the front lower area, with reference to the normal operating position, a hole 32 is present on each side and through it a screw 33 can be inserted, which simultaneously forms the pivot bearing 13. Starting from these holes 32, a roughly semicircular cutout 36 (see FIG. 1 as well) has been removed, which makes it possible for heel element 14 to be folded deeply down backwards and simultaneously permits one heel element of the boot sole to protrude out of the binding, as is recognized best from FIG. 3. In the upper part of the heel element facing outward, a clip 22 is attached with which strap 21 is held. One of the guide loops 19 is attached on each side of the heel element, as well as possibly the hook and loop closure 37. This hook and loop closure can also be applied to an extra strip 38 made of plastic.

Figure 6B:
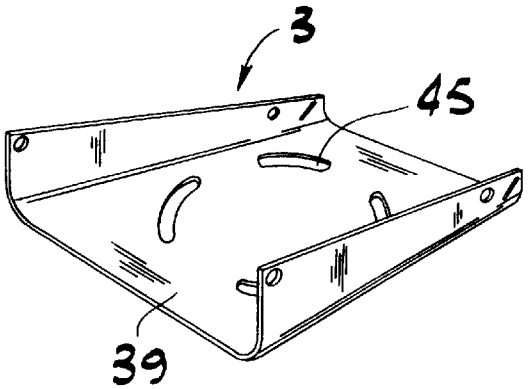
FIGS. 6*a*–6*c* show various configurations of the base element of the snowboard binding.
Figure 6C:
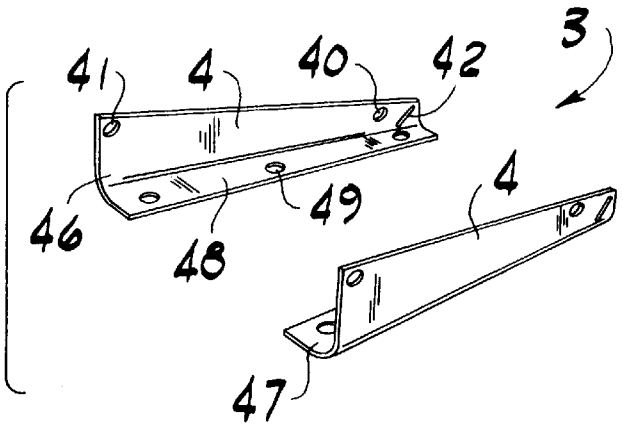
Figure 6A:
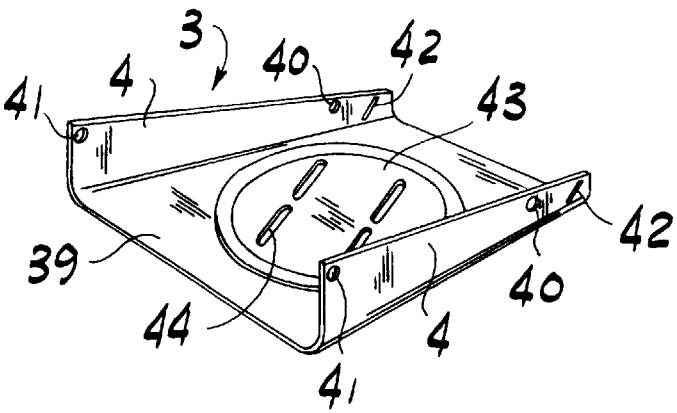

FIG. 6 shows various embodiments of the base element 3. In FIG. 6*a,* this base element consists of a flat plate 39, which is bent upwards at right angles on both sides into the side walls 4. The side walls 4 have a profile which is inclined downwards to the front and each has holes 40,41 to house the screws 12,13 (FIG. 1). Additionally, one slot 42 is provided in front of the hole 40 on each side for threading through the strap 36. As is known from DE-4,219,036.3 A1, the base plate 39 has a circular central opening, into which a disk 43 can be inserted that has a rim extending over said opening. The disk 43 also has four rounded slots 44, with which the disk 43 and thus the entire binding can be screwed onto the snowboard surface. The base plate 39 can be turned relative to disk 43, in order to be able to adjust the angle of the binding continuously with respect to the skiing direction.

FIG. 6*b* shows a somewhat different variant of the base plate 39, which differs from that of FIG. 6*a* in that, in place of the circular opening and disk 43, four rounded slots 45 arranged in an offset pattern are provided with which the base plate 39 can also be attached to the snowboard. Then, however, it can be turned only to the extent provided by the length of the rounded slots 45. For further turning, the screws must be completely removed and reinserted at other points.

FIG. 6*c* shows an additional variant. Here the base plate is divided into two angular-shaped elements 46,47 which are mirror-symmetric with respect to one another and likewise have the side walls 4. The arms 48 running parallel to the snowboard surface have holes 49, with which these elements can likewise be fastened to the snowboard surface. All the other holes or slots 40,41,42 correspond to the embodiment example 6*a*. The other parts of the binding are fastened by way of these holes or slots to these base elements 47,48.

Figure 7:
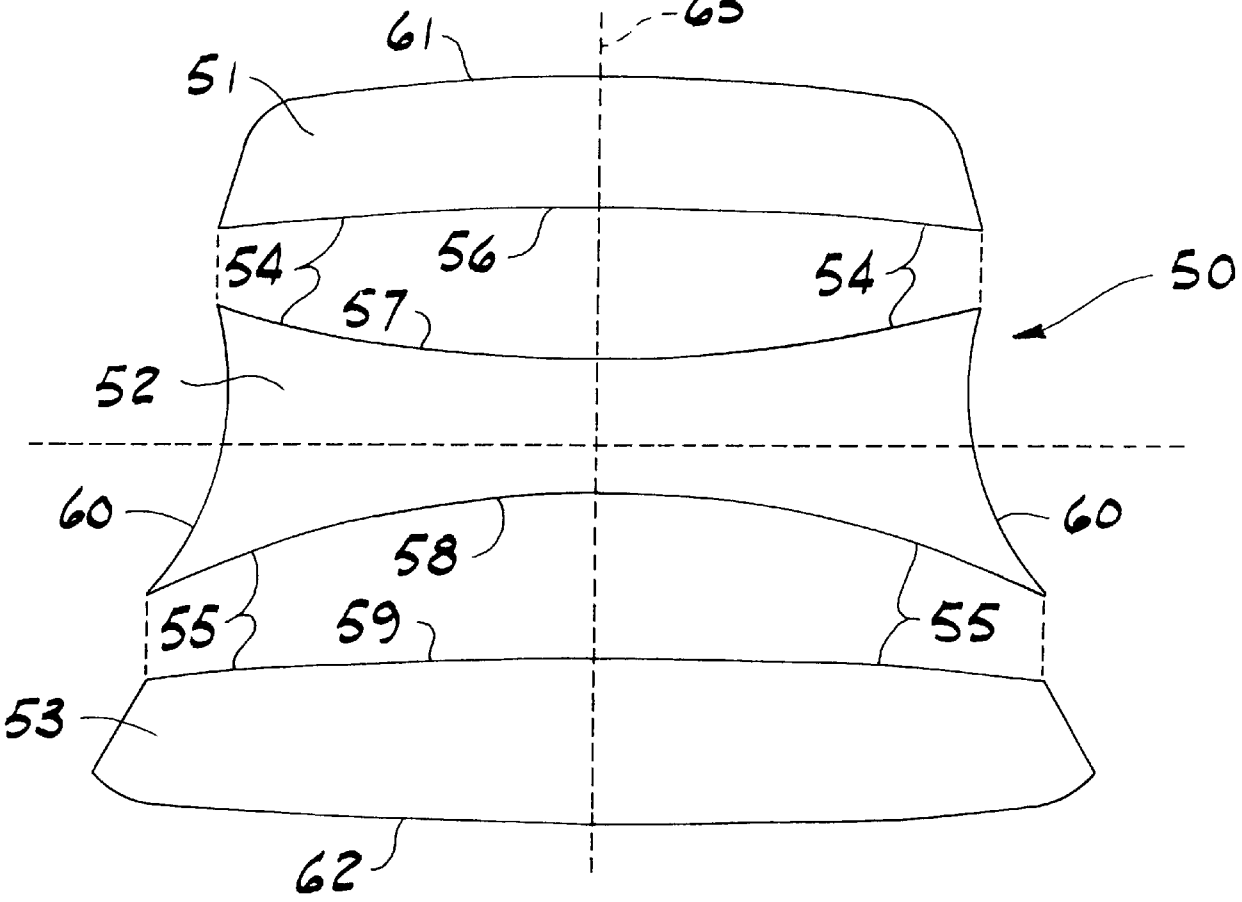
FIG. 7 is an illustration of the cuttings for forming the instep element according to a modification of the invention.

FIG. 7 shows cuttings for manufacturing the instep element according to a variant of the invention, in which the instep element is better fitted to the shape of the instep of the boot so that forces can be better transferred from the skier's foot onto the front edge of the snowboard. Three parts 51, 52, 53 are used for manufacturing the instep element 50. The first part 51 is an elongated strip that covers the areas of the toes of the boot (see FIG. 8). This strip is curved slightly outward, that is, convexly, at its edge 61 pointing towards the toes, and at its opposite edge 56 it is curved inward, that is, concavely, specifically, inside a middle section bounded by two dashed lines. From these dashed lines outward, the strip 51 has straight edge sections 54.

On its edge pointed towards the strip 51, the second strip 52, which covers the mid-foot area of the boot (see FIG. 8), at first has the straight sections 54, the length of which is identical to that of the sections 54 of strip 51. Here too, the end of the straight sections 54 is marked by dashed lines, that is, the edge 57 is curved inward or concavely, with the curvature of the edge 57 being greater, that is, having a smaller radius of curvature than edge 56 of strip 51. The two strips 51, 52 are fastened together at the edges 54, 56, 57, for instance, by sewing. The two sides 60 of the strip 52 are likewise curved inward.

Figure 8:
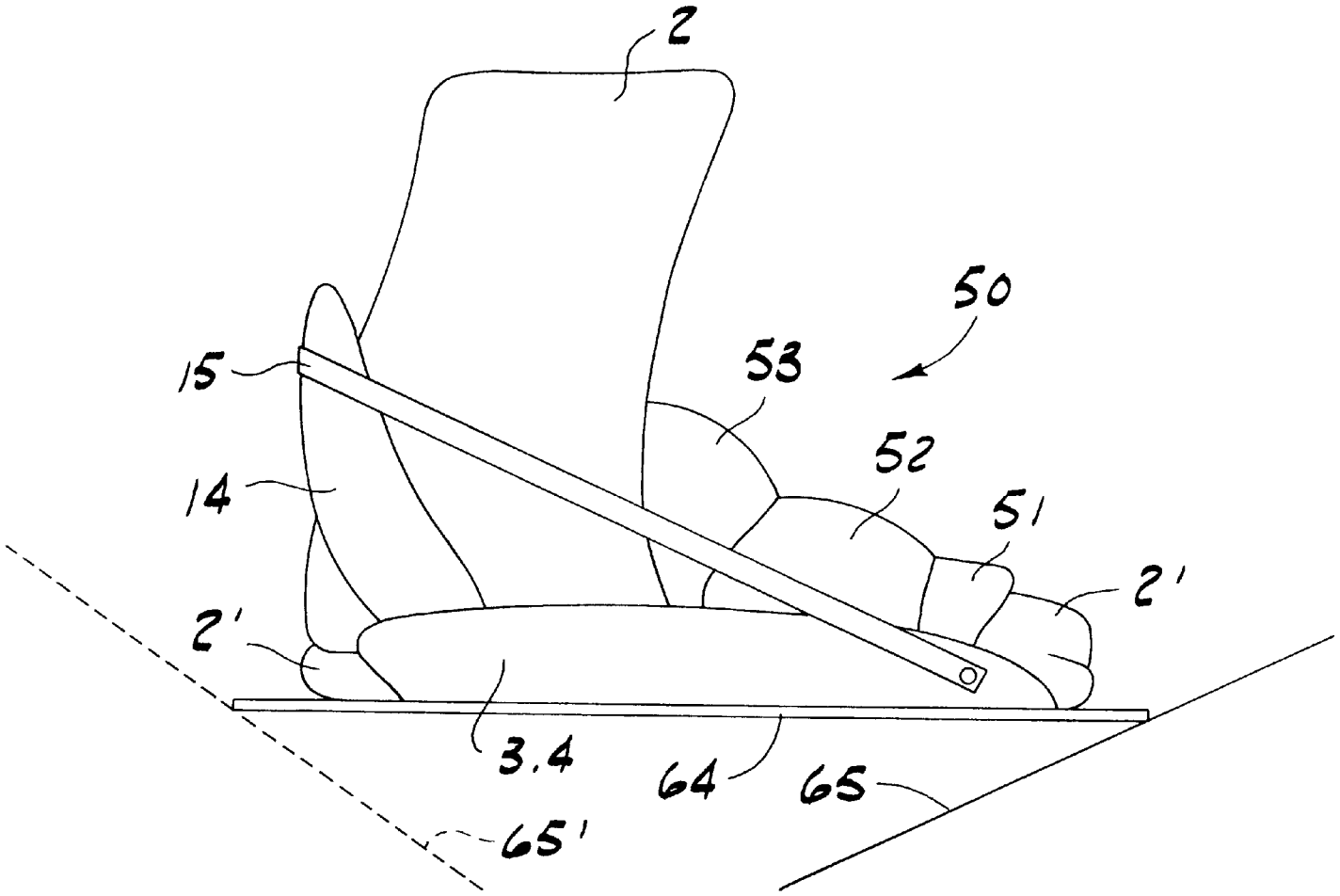
FIG. 8 is a lateral view of the snowboard binding with instep element according to the embodiment example of FIG. 7.

The third strip 53, which covers the instep of the boot (see FIG. 8) is similarly fitted to middle strip 52, with the opposing edges having from inside to outside a straight section 55, which is bounded by the dashed lines, followed in strip 52 by a section 58 curved inward, that is, concavely, while in strip 53 a section 59 slight curved outward, or convexly, follows. The two strips 52 and 53 are also connected along the edges 55, 58, 59, for instance, by sewing. The edge 62 opposite the edges 55 and 59 of strip 53 is once again curved outward, slightly convexly. If the three strips 51, 52, 53 are connected in the manner described and then bent over the front portion of the boot, then one achieves the shape of instep element 50 as illustrated in FIG. 8, one that is optimally fitted to the instep and front foot and thus permits a wide distribution of the forces appearing when there is a load on the front edge of the snowboard, which tend to lift up the heel of the boot. This situation is shown in FIG. 8, in which the front edge of the snowboard 64 makes contact with a slope 65, while the heel 2" is lifted up and the toe area 2' of the boot puts pressure on the front edge of the snowboard 64.

The opposite situation, in which the rear edge of the snowboard 64 makes contact with a slope 65' and the heel area 2" exerts the essential pressure, while the toe area 2' is lifted up, is likewise shown in FIG. 8. In this case, the lines of force run from the boot shaft via the heel element 14, the belt 15 and the base plate 3, 4 to the toe area, and the instep element 50 need only absorb relatively small forces, merely preventing the boot as a whole from tipping over with respect to the binding.

From FIG. 8 it is also understood that under load the belt 15 transfers the forces directly from the upper side of the heel element 14 onto the front side of the binding into the toe area 2' and thus directly brings about a raising of the toe area under load on the rear edge of the snowboard, which was not the case in conventional shell bindings.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A snowboard binding for binding a snowboard boot to a snowboard's upper surface, the binding comprising:

a base element to be fastened to the snowboard's upper surface, an instep element fastened onto the base element which instep element grips partially over the snowboard boot, a heel element which supports the snowboard boot's rear side and is pivotable rearwardly on the base element into an entry position in which the heel element lies generally parallel to the snowboard surface, and in which entry position the snowboard boot is insertable into the binding, and an actuation device that pivots and holds the heel element forwardly into a closure position forwardly, in which closure position the heel element supports the snowboard boot and presses it against the instep element;

the actuation device having a first strap that is attached at both sides to a front area of the base element and wraps around the heel element on the heel element's outside.

2. The snowboard binding according to claim 1 wherein the actuation device further comprises a second strap which is attached to the heel element's upper area and is connected to the first strap such that a tensile force acting on the second strap displaces the first strap along the outside of the heel element in the direction of the second strap's free end and thereby pivots the heel element into the closure position.

3. The snowboard binding according to claim 2 wherein the first strap is adjustable in length.

4. The snowboard binding according to claim 3 comprising a stop which determines maximum shortening of the second strap.

5. The snowboard binding according to claim 4 wherein the stop comprises a clip fastened to the upper end of the heel element and through which clip the second strap is threaded, and wherein the second strap wraps around the first strap and is threaded through a strap buckle by which it is held in place in a set adjusted length.

6. The snowboard binding according to claim 1 wherein the first strap is threaded through guide loops attached to both sides of the heel element.

7. The snowboard binding according to claim 6 wherein the loops attached at both sides of the heel element are equipped with a hook and loop closure.

8. A snowboard binding for binding a snowboard boot to a snowboard's upper surface, the binding comprising:

a base element to be fastened to the snowboard's upper surface, an instep element fastened onto the base element which instep element grips partially over the snowboard boot, a heel element which supports the snowboard boot's rear side and is pivotable rearwardly on the base element into an entry position in which the heel element lies generally parallel to the snowboard surface, and in which entry position the snowboard boot is insertable into the binding, and an actuation device that pivots and holds the heel element forwardly into a closure position forwardly, in which closure position the heel element supports the snowboard boot and presses it against the instep element;

the instep element comprising flaps which are attached to the base element, which flaps are guided initially essentially vertically upward and overlap in a central area and thus form a tunnel, the height of which tunnel diminishes in the direction of the boot toe.

9. The snowboard binding according to claim 8 wherein the flaps are held in overlapping relationship by straps in conjunction with strap buckles.

10. The snowboard binding according to claim 9 wherein there are two of said straps that hold the instep element flaps in overlapping relationship and two of said strap buckles, wherein each of said straps is threaded through one of the buckles and wherein the straps are connected to each other by way of a loop.

11. The snowboard binding according to claim 8 wherein both flaps that form the instep element are each strengthened by a stiffening element which is attached to the base element and extends essentially vertically upward from the base element.

12. The snowboard binding according to claim 8 wherein the flaps forming the instep element are padded on the inside.

13. The snowboard binding according to claim 1 wherein the heel element consists of a strengthening element and a padding facing the snowboard boot.

14. The snowboard binding according to claim 1 wherein in that the instep element is fitted to the shape of the boots front foot part and covers it over a wide area.

15. The snowboard binding according to claim 14 wherein the instep element is constructed from the connection together of three strips having mutually opposing edges which are curved at least in sections, and wherein the connected strips are curved over the instep and front foot of the boot and hence form a tunnel-like support covering a large part of the front foot of the boot.

16. A snowboard binding for binding a snowboard boot to a snowboard's upper surface, the binding comprising:

a base element to be fastened to the snowboard's upper surface, an instep element fastened onto the base element which instep element grips partially over the snowboard boot, a heel element which supports the snowboard boot's rear side and is pivotable rearwardly on the base element into an entry position in which the heel element lies generally parallel to the snowboard surface, and in which entry position the snowboard boot is insertable into the binding, and a first strap that is pivotably attached at both sides to a front portion of the base element and wraps around the heel element and is capable to hold the heel element forwardly in a closure position in which the heel element supports the snowboard boot and presses it against the instep element.

17. The snowboard binding according to claim 16 further comprising a second strap which is attached to the heel element's upper area and is connected to the first strap such that a tensile force acting on the second strap displaces the first strap along the outside of the heel element in the direction of the second strap's free end and thereby pivots the heel element into the closure position.

* * * * *